United States Patent [19]

Gayler

[11] Patent Number: 4,617,898

[45] Date of Patent: Oct. 21, 1986

[54] FUEL DELIVERY TO INTERNAL COMBUSTION ENGINES

[75] Inventor: Robert J. Gayler, Mersham, England

[73] Assignee: Piper FM Limited, Ashford, England

[21] Appl. No.: 486,288

[22] PCT Filed: Jul. 7, 1982

[86] PCT No.: PCT/GB82/00199

§ 371 Date: Mar. 3, 1983

§ 102(e) Date: Mar. 3, 1983

[87] PCT Pub. No.: WO83/00191

PCT Pub. Date: Jan. 20, 1983

[30] Foreign Application Priority Data

| | | | |
|---|---|---|---|
| Jul. 7, 1981 | [GB] | United Kingdom | 8120988 |
| Sep. 8, 1981 | [GB] | United Kingdom | 8127132 |
| Oct. 29, 1981 | [GB] | United Kingdom | 8132624 |

[51] Int. Cl.[4] ..... F02M 41/04

[52] U.S. Cl. ..... 123/460; 123/470; 123/482; 123/510

[58] Field of Search ..... 123/452, 460, 470, 458, 123/478, 482, 492, 493, 510; 261/DIG. 39

[56] References Cited

U.S. PATENT DOCUMENTS

| | | | |
|---|---|---|---|
| 3,628,024 | 12/1971 | Clemochowski | 123/460 |
| 3,656,464 | 4/1972 | Hilborn | 123/470 |
| 3,670,706 | 6/1972 | Fujisawa | 123/493 |
| 3,734,068 | 5/1973 | Reddy | 123/485 |
| 3,949,714 | 4/1976 | Mitchell | 123/458 |
| 4,015,571 | 4/1977 | Stumpp | 123/452 |

FOREIGN PATENT DOCUMENTS

| | | | |
|---|---|---|---|
| 0014552 | 11/1971 | Australia . | |
| 2035149 | 4/1971 | Fed. Rep. of Germany . | |
| 1057300 | 3/1954 | France | 123/470 |
| 1475616 | 2/1967 | France . | |
| 2051385 | 4/1971 | France . | |
| 1098823 | 1/1968 | United Kingdom . | |
| 1286851 | 8/1972 | United Kingdom . | |
| 1482194 | 8/1977 | United Kingdom . | |
| 2007296 | 5/1979 | United Kingdom . | |

*Primary Examiner*—W. R. Wolfe

*Attorney, Agent, or Firm*—Flynn, Thiel, Boutell & Tanis

[57] ABSTRACT

Fuel for a working cylinder chamber (8) of an internal combustion engine is drawn through an atomizing nozzle (39) from an accumulator (30). Fuel is supplied by a low pressure source (12) through a variable constriction (16) linked to the throttle (4) and through a solenoid valve which is pulsed at a frequency proportional to engine speed.

8 Claims, 13 Drawing Figures

FUEL DELIVERY TO INTERNAL COMBUSTION ENGINES

The present invention relates to an apparatus for supplying appropriate charges of fuel to the working chambers of internal combustion engines.

According to the present invention, there is provided a method of supplying appropriate charges of fuel to a working chamber of an internal combustion engine during induction of changes of air through an adjustable throttle, in which the fuel is passed, in either order, through a variable constriction the flow resistance of which is progressively reduced with increasing throttle opening and through an on-off valve which is cyclically opened for an essentially constant time at a frequency proportional to engine speed.

Also according to the present invention, there is provided apparatus for supplying an appropriate charge of fuel to a working chamber of an internal combustion engine during an intake stage of an operating cycle, the engine having an air intake throttle valve, the apparatus comprising a metering valve operable in response to operation of the throttle to vary the flow area of a variable fuel metering orifice to reduce the flow resistance of the metering orifice progressively with increasing throttle opening, an on/off valve connected in series (in either order) with the metering valve between a fuel source and a delivery nozzle in the intake duct of the working chamber downstream of the throttle, and control means responsive to engine speed for cyclically opening the on/off valve at a frequency proportional to engine speed, the time interval during which the on/off valve is open being essentially independent of engine speed at least under steady load and speed. Preferably an accumulator is included to smooth the supply to the nozzle.

Advantageously, the apparatus includes means responsive to sudden throttle opening to increase temporarily the rate of fuel supply to the nozzle, for example by holding the on/off valve in its "on" position to provide an enriched mixture during the rapid movement of the throttle.

Usually, a richer mixture is required in the lower and uppermost portions of the speed range than in the remainder of the speed range. This can be readily achieved by arranging for the control means to increase the length of the "on" time in each cycle of the on/off valve by an appropriate corrective amount.

Also, the control means may include sensors for measuring one or more other parameters such as ambient and engine temperatures and barometric pressure and include means for carrying out further corrective adjustment of the "on" time in each operating cycle of the "on/off" valve.

All such corrective adjustments to the "on" time, including enrichment for starting, can be effected by a control system, such as a microprocessor, of relatively simple construction since it is only required to make corrective adjustments over a relatively small range, bearing in mind that the large scale "coarse" adjustment is effected by the metering valve. In a preferred arrangement, the control system includes a pulse generator constructed to generate pulses at a frequency proportional to engine speed but of constant length corresponding to a rich mixture, the control system then serving to terminate the pulses by clipping their end portions to give the required fuel delivery. Thus, in the event of failure of the microprocessor or other control system, a vehicle can still be driven although with a rich mixture.

Preferably, for liquid fuel, the nozzle has a capillary fuel delivery tube within an air passage connected to receive unthrottled air, the air passage being convergent around the outlet end of the fuel delivery tube and leading to an outlet in a wall of the inlet passage to the working chamber in a position where each successive charge of air drawn into the combustion chamber will reduce the static pressure and thus draw in air from the nozzle air passage. This in turn reduces the static pressure at the fuel delivery tube outlet and draws off and atomises fuel from the tube. At other stages in the engine cycle, the surface tension of the fuel prevents any substantial flow of fuel. Where the fuel is supplied under pressure, this should be insufficient to overcome the surface tension when air is not being drawn past the nozzle.

Preferably, the passage around the tube is gradually convergent over a sufficient length to ensure that the velocity of the air drawn past the end of the tube is effectively supersonic under all running conditions, thereby avoiding sudden charges and instabilities in the operation of the nozzle.

Advantageously, the air inlet duct leading from the throttle towards the combustion chamber is formed with a constriction to reduce the static pressure adjacent the nozzle. This constriction should however not be so narrow as to cause sonic flow conditions under maximum power or engine speed conditions. Accordingly, the constriction design should ensure that the mean flow velocity during intake of a charge of air should not appreciably exceed 125 meters/sec.

When the engine has a plurality of working chambers, the fuel delivery apparatus will have a separate nozzle for each air inlet duct (which may serve one or more working chambers), the remainder of the fuel delivery apparatus being common to all nozzles which are effectively connected in parallel. With the usual phase differences between the various working chambers, each nozzle in turn will be caused to deliver fuel as a charge of air is drawn through its associated air inlet passage during the induction phase, thereby helping to ensure that fuel cannot escape from the other nozzles.

Embodiments of the invention will now be described by way of example with reference to the accompanying drawings, in which.

Figure 1:
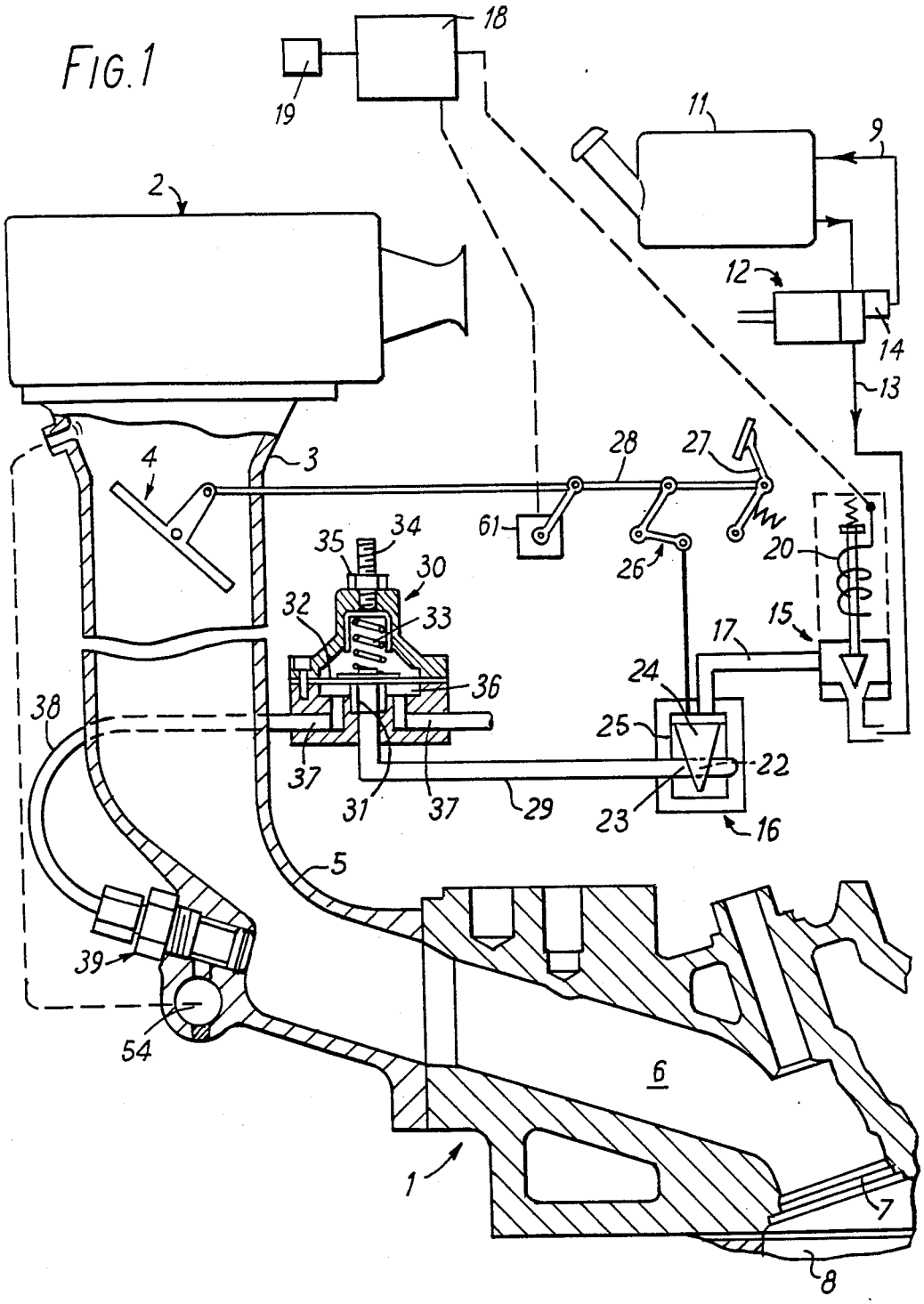
FIG. 1 shows diagrammatically the air and fuel delivery systems or a four stroke spark-ignition internal combustion engine.

FIG. 1 shows a portion of the cylinder head 1 of an internal combustion engine. During an induction stroke, air is drawn in from the atmosphere through a conventional air filter assembly 2 into an induction pipe 3 past a butterfly throttle 4 and into an inlet manifold 5. The air is drawn through the appropriate branch of the manifold 5 into an intake passage 6 in the cylinder head 1 and thence through a valve seat 7 (controlled by a poppet valve, not shown) into the combustion chamber 8. During all other stages of the operating cycle, the valve seat 7 is closed by the poppet valve and no air flow will occur in the passage 6.

Liquid fuel for the engine is stored in a tank 11. Fuel is drawn from the tank 11 by an electrically driven pump 12 and is delivered to a line 13 the pressure in which is maintained at about eighteen pounds per square inch by a relief valve 14 which spills excess fuel back into the tank 11 through a spill line 9.

The line 13 leads to a solenoid operated valve 15 and a variable-orifice valve 16 which are connected in series in either order by a line 17. An electronic control unit 18 receives signals from an engine driven tachometer 19 and delivers to the solenoid 20 of the valve 15 pulses of normally constant length, at a frequency proportional to the engine speed registered by the tachometer 19. Typically, each pulse has a duration in the range 3–10 milliseconds and the valve 15 is effectively fully opened during this period.

The metering valve 16 defines a variable area cosntriction 22 which is defined conveniently by the registering areas of a slot 23 and a triangular opening 24 in two adjacent relatively movable members. In this embodiment, the member 25 formed with the triangular slot 24 is interconnected through a linkage 26 with the throttle 4 in such a manner that opening movement of the throttle 4 (hereby an accelerator pedal 27 and linkage 28) causes the member 25 to move downwards relative to the slot 23 so that the width, and thus flow area, of the orifice 22 is increased.

By suitable choice of the characteristics of the linkage 26 (which may for example include a non-linear cam) and by appropriate shaping of the opening 24, the required characteristics can be obtained. In general, the resistance to flow of the opening 22 should be similar to that of the appropriate jet or jets of a conventional carburettor which would be used with the engine.

Fuel which has passed through the valves 15 and 16 is delivered through a line 29 to an accumulator and distributor valve assembly 30. The fuel from the line 29 is supplied to the interior of a tubular valve seat 31 against which bears the underside of a diaphragm 32 under the pressure of a compression spring 33, the tension of which can be adjusted by means of a screw 34 with lock nut 35.

The tension in the spring 33 is adjusted so as to arrange that the pressure in an annular outlet chamber 36 and in the line 29 is normally about eight pounds per square inch.

The outlet chamber 36 is permanently connected by outlet ports 37 to lines 38 leading to fuel delivery nozzles 39, there being one such nozzle 39 for each inlet passage 6.

Figure 2:
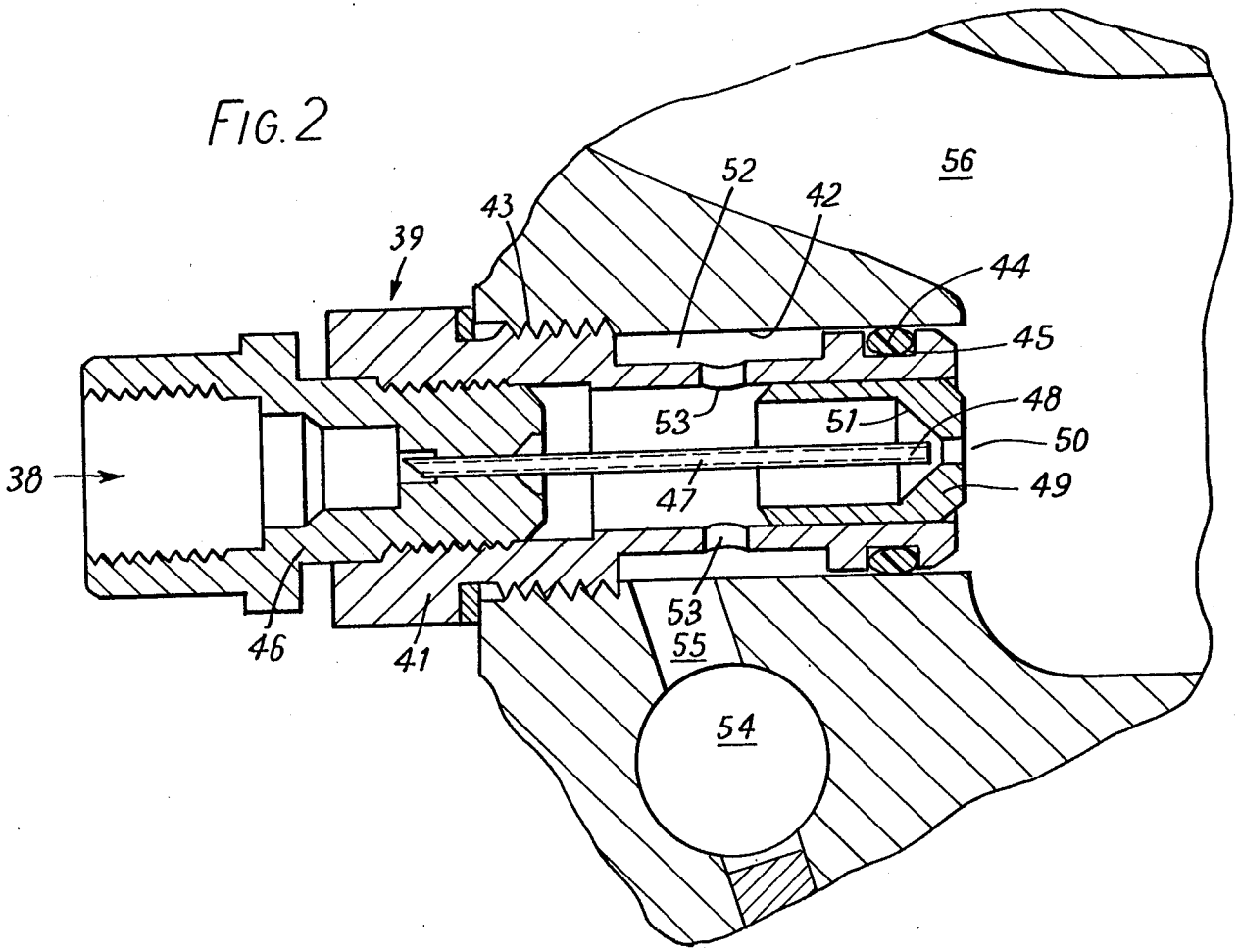
FIG. 2 shows a fuel delivery nozzle of FIG. 1 on an enlarged scale.

As shown in FIG. 2, each nozzle 39 has a hollow body 41 mounted in a bore 42 in the inlet manifold 5 by means of screw threads 43. At its discharge end, an O-ring 44 is located in a groove 45 to form a seal against the wall of the bore 42.

A ferrule 46 is engaged in the hollow body 41 and connected to the line 38. A long capillary tube 47 is engaged in the ferrule 46 and has its outlet end 48 adjacent an outlet orifice 50 in an orifice member 49 which is pressed into the interior of the body 41 and has a frusto-conical surface 51 converging towards the orifice 50.

An annular air space 52 surrounds a reduced portion of the body 41 and communicates with the interior of the body 41 through holes 53 and with an air supply duct 54 by way of a short passage 55. The duct 54 is connected to receive air from the outlet of the air filter 2 upstream of the throttle 4.

Adjacent the nozzle 39, the inlet manifold 5 is formed with a venturi-like constriction 56 the effect of which is to reduce the static component of pressure adjacent the nozzle outlet orifice 50 when a charge of air is being drawn into the combustion chamber 8. This pressure reduction, coupled with the pressure reduction created by the throttle 4 and inlet manifold 5 draws air from the duct 54 into the interior of the nozzle body 41 and through the space between the capillary tube tip 48 and the conical surface 51. As a result of the air flow in this region, the static pressure component is reduced and the fuel pressure in the line 38 is able to overcome the surface tension at the tube tip 48 with the result that fuel is drawn from the capillary tube 47 and atomized. The resulting mixture of air and fuel travels adjacent the axis of the inlet passage 6 into the combustion chamber 8 with little risk of wetting the walls of the passage 8.

Towards the end of the induction stroke in the chamber 8, another chamber will be undergoing its induction stroke under higher speed flow conditions than the first combustion chambers. Accordingly, the nozzle associated with this second combustion chamber will take over and will atomize all the fuel flow available from the accumulator and distributor valve 30. As a result, the last part of the charge entering the first combustion chamber may consist essentially of air alone with the result that a stratified charge may be possible within the combustion chamber.

In order to supply enriched fuel for acceleration, a device 61 sensitive to rapid movement of the throttle linkage 28 in the opening direction may feed a signal to the electronic control unit 18 to cause the latter to operate the solenoid-operated valve 20 continuously for a short time so as to greatly increase, temporarily, the fuel supplied to the nozzle 39.

Figure 3:
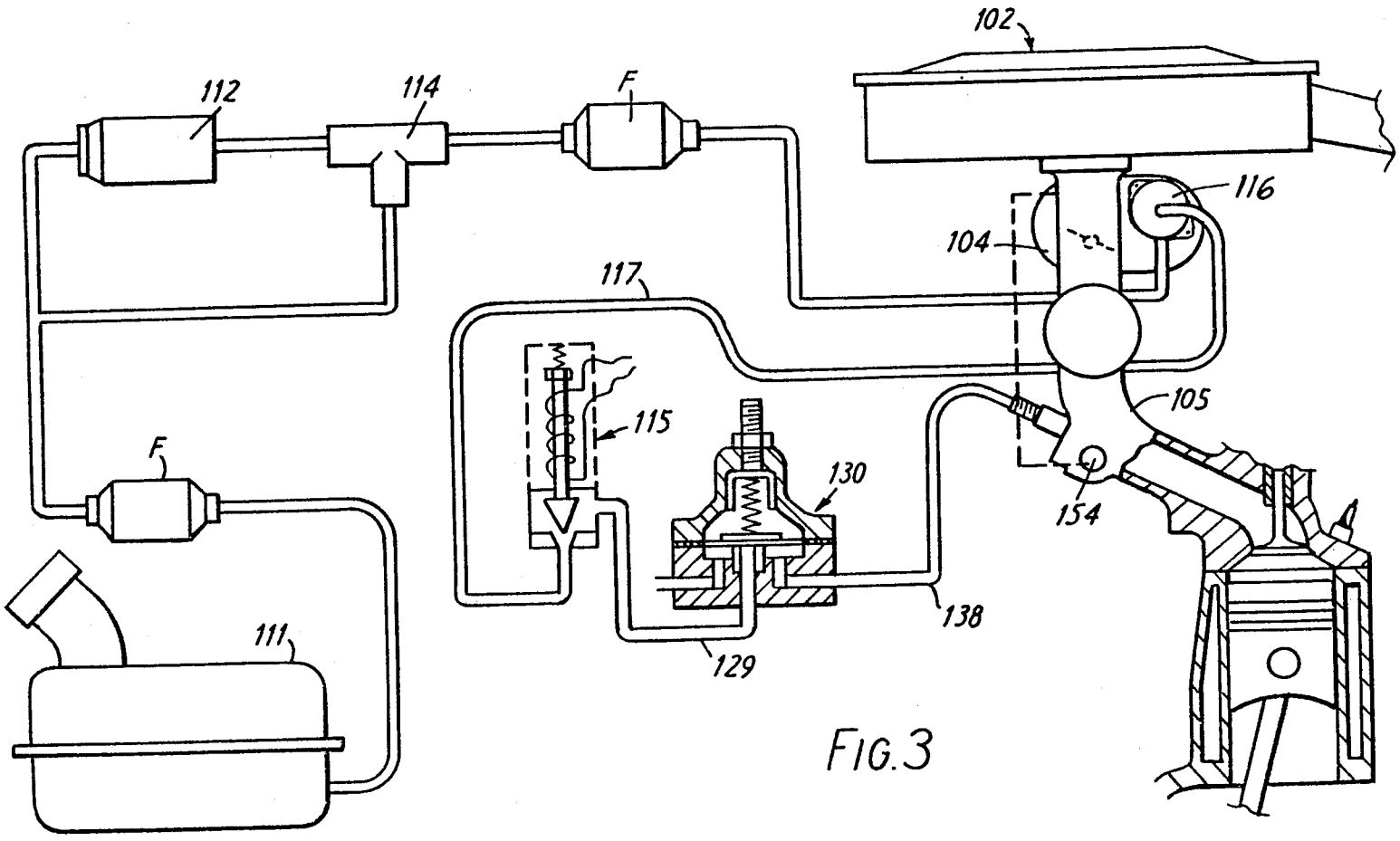
FIGS. 3 and 4 are views corresponding to FIGS. 1 and 2 of a modified system.
Figure 4:
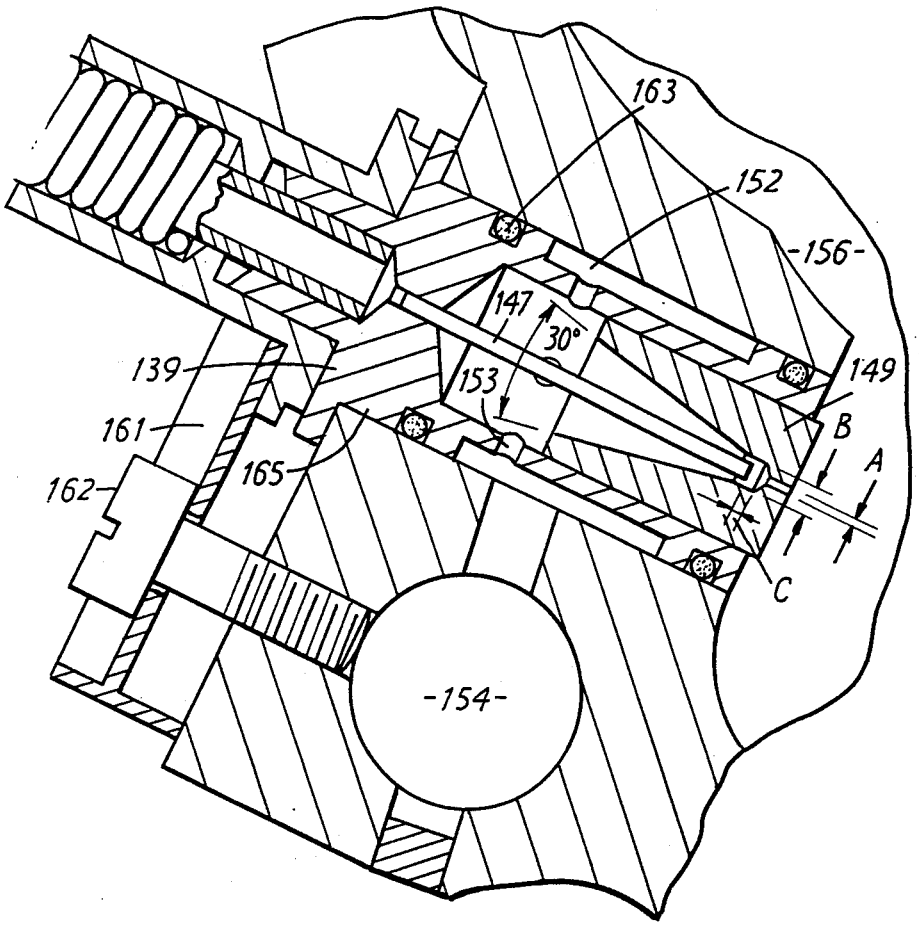
Figures 5, 6:
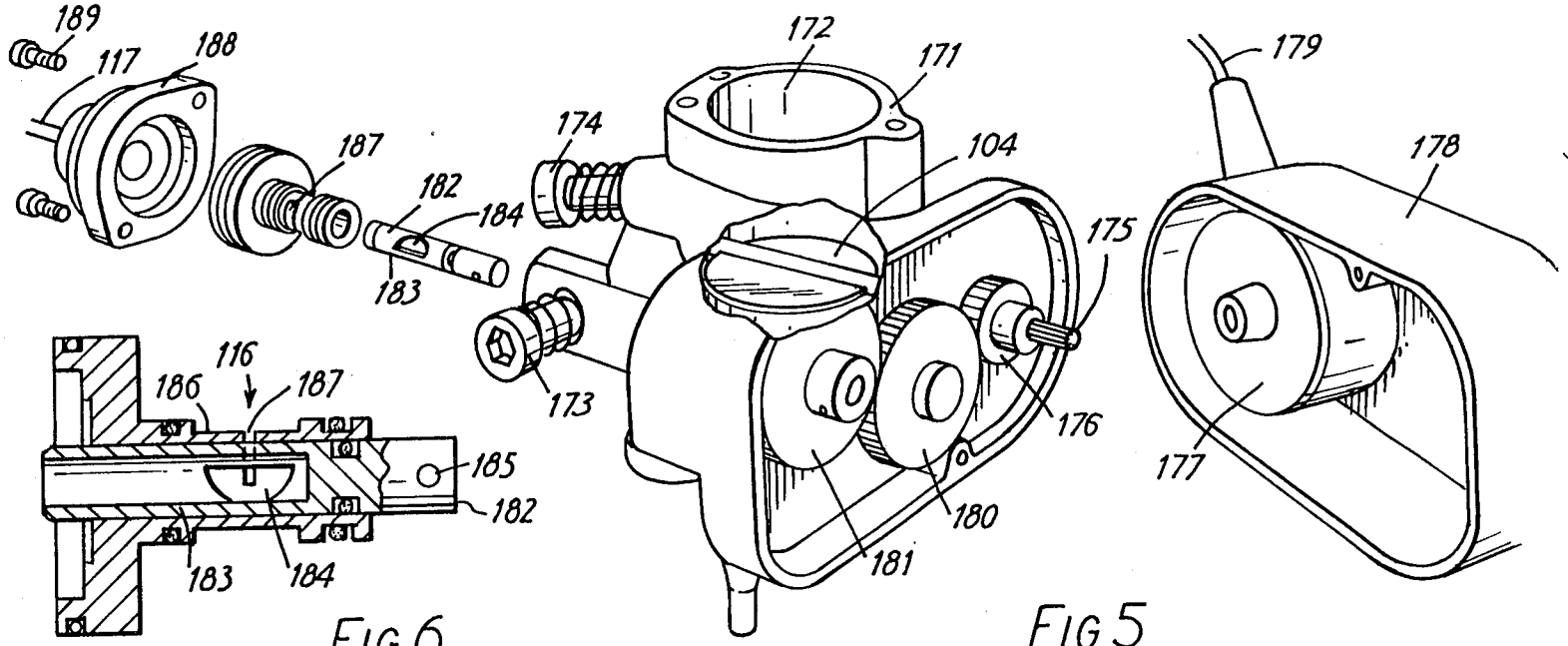
FIG. 5 is an exploded view of the throttle valve and variable constriction of the system shown in FIG. 3.
FIG. 6 is an axial sectional view of the variable constriction forming elements of FIG. 5.

In the system shown in FIGS. 3 to 5, elements corresponding to the system shown in FIGS. 1 and 2 are indicated by the same reference numerals increased by 100. In this system, the variable constriction 116 is upstream, in the direction of fuel flow, of pulser valve 115. Fuel filters F are advantageously included in the fuel supply lines.

The nozzle construction shown in FIG. 4 may also be used in the system of FIGS. 1 and 2. In the arrangements shown in FIG. 4, the nozzle 139 is retained in position by a clamping plate 161 secured by a screw 162. An additional sealing O-ring 163 is located in a groove 164 in the non-screw threaded shank 165 of the nozzle.

The orifice member 149 has its frusto-conical surface 151 extending for substantially the whole length of the orifice member at a semi-vertical angle of 15°. If A is the diameter of the outlet orifice, B is the internal diameter of the portion of the orifice member surrounding the end of the capillary tube 147 and C is the spacing between the end of the capillary tube 147 and the end of the cylindrical portion of diameter B, the following tests results were obtained using a capillary tube of internal diameter 0.6 mm and external diameter 0.89 mm, the flow rates corresponding to continuous operation of the nozzle;

1. $A\phi=0.381$ mm $\phi$ and $B\phi=1.2$ mm $C=0.381$ mm.

Very good atomisation at low flows, (30–80 cc/min) but at flows over 80 cc/min start to form a jet and at 100 cc/min it becomes a pure jet.

2. $A\phi=0.381$ mm $\phi$ and $B\phi=1.1$ mm $C=0.381$ mm.

Just as good atomisation as above but can flow up to 100 cc/min before we can see the jet start, it becomes a pure jet at around 120/130 cc/min.

3. $A\phi=0.381$ mm $B\phi=1.2$ and $C=2.54$ mm.

A very narrow cone with good atomisation and shut-off point but starts to form a jet at around 100 cc/min and forms a pure jet at 150 cc/min.

$A\phi=0.381$ mm $B\phi=1.2$ and $C=1.524$ mm.

Not such a narrow cone as above and around the same shut-off-point as well as flows with producs a jet.

4. $A\phi=0.381$ mm $B\phi=1.3$ and $C.=0.381$ mm.

Good atomisation to around 200 cc/min then starts to become a jet. Shut-off-point is around (70/80 cc/min).

FIG. 5 shows an exploded view of the air throttle valve used in the arrangement of FIG. 3. A throttle valve body 171 defines an inlet duct 172 containing the butterfly-type valve 104. The idling position of the latter is defined in the normal way by an adjustable stop screw 173, and an air bypass (not shown) extends around the valve 104 in its idling position and is controlled by an adjustable needle-ended screw 174.

The shaft 175 of the valve 104 is extended to carry a gear wheel 176 from which it projects with a non-circular end portion which engages in a potentiometer 177 mounted in a cover 178. The potentiometer 178 is conveniently of the kind available from Bourns Electronics Limited of Hodford House, 17 High Street, Hounslow, Middlesex, England, and a part No. 3802B. This has a value of 5 Kilohms and has a laser-trimmed plastics-coated ceramic element. It has double contact wiper arms each of which comprises two resilient arms of different lengths to minimise intermittent contact due to mechanical resonance of the wiper arms.

The potentiometer 177 is connected by leads 179 to the remainder of the control circuit to be described below. The gear wheel 176 meshes with an idler gear wheel 180 which in turn meshes with a further gear 181 carried by an inner, shaft element 182 of the variable constriction 116. The shaft member 182 has a hollow portion 183 formed with a D-shaped slot 184. The gear 181 is mounted on the right-hand end of the shaft element 182 by means of a pin passing through a hole 185. The shaft element itself is rotatably mounted in a stationary element 186 in which is cut a slot 187 extending around about half its circumference. The stationary element 186 is mounted in the throttle body 171 with an arrangement (not shown) permitting its angular adjustment during setting up of the system.

The fuel supply line 117 is connected to the centre of an end cap 188 secured by screws 189 to the throttle body 171. Fuel can thus pass from the line 117 into the interior of the hollow portion 183 to pass outwards through whatever length of the slot 187 is in register with the D-shaped opening 184. Typically, in the idling position, the area of the slots which are in registration corresponds to that of an idling jet of a corresponding conventional carburetor while at full throttle opening the area in register corresponds to that of the main jet.

Figure 7:
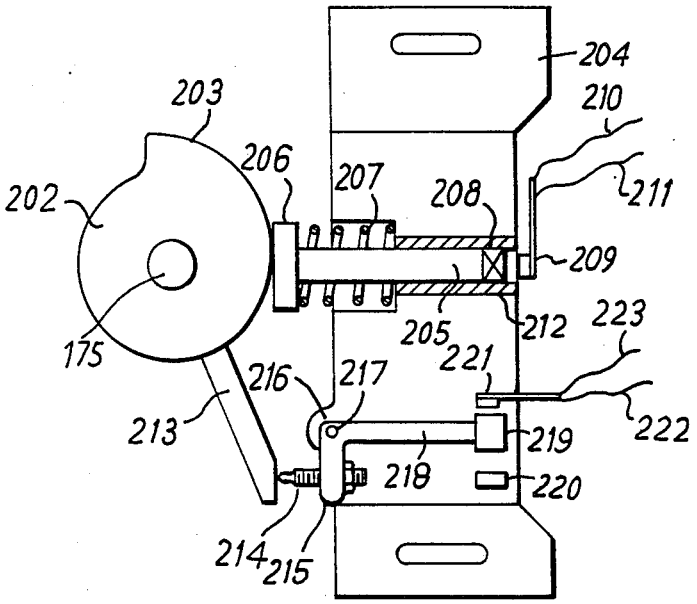
FIG. 7 shows diagrammatically an alternative throttle angle sensor.

FIG. 7 shows diagrammatically an alternative throttle angular position sensor.

Mounted on the throttle spindle 175 is a cam 202 having an equiangular spiral portion 203 extending over 90°. Adjacent the cam is mounted a base 204 of the sensor in which a cam follower 205 in the form of a plunger is slidably mounted. The head 206 of the plunger 205 is held in firm contact with the cam surface 203 by a spring 207.

At its opposite end, the plunger 205 carries a magnet 208 secured to it, for example, by an epoxy resin adhesive. Mounted so as to be just beyond the range of movement of the magnet 208 is a Hall effect device 209 having output leads 210 and 211 to which it supplies a signal representative of the distance between the magnet 208 and the device 209 and thus of the angle between the cam 202 and spindle 201 and some predetermined position such as that shown in the drawing corresponding to the idling position of the internal combustion engine. Where the base 204 is formed by a die casting, the plunger 205 may be slidable in an insert sleeve 212.

The cam 202 may also carry an arm 213 which, at the end of the return movement of the throttle spindle 175 to its idling position makes contact with an adjustable stop screw 214 in the short arm 215 of a bellcrank 216 pivotally mounted on a pin 217 on the base 204. The long arm 218 of the bellcrank 217 carries a second magnet 219.

When the arm 213 is out of contact with the stop screw 214, the magnet 219 is attracted to and engages a further magnetic keeper block 220 on the base 204. When, however, the arm 213 moves into the idling position it engages the stop screw 214 to turn the bellcrank 216 about its pin 217 and thereby swing the magnet 219 away from the keeper 220 and into much closer proximity with a second Hall effect device 221 thereby causing an abrupt change in the signal delivered by the latter to its output leads 222 and 223. Movement of the magnet 219 between its two end position can readily be effected by less than 1° of movement of the cam 2 into and out of the idling position.

The magnets 208 and 219 may for example be of HYCOMAX III supplied by BOC Magnets of Ferry Lane, Rainham, Essex and may for example be 6 mm. in diameter and 4 mm. in length with their axes perpendicular to the respective Hall effect devices. The Hall effect devices 209 and 221 may be type 9SS Series linear output Hall effect transducers supplied by the Micro Switch Division of Honeywell.

Commonly, as in a carburetor, the air is passed through a Venturi constriction to create a pressure signal representative of the air flow into the combustion chambers. Such an arrangement inevitably introduces an element of delay and it is difficult to transduce accurately and instantaneously a pressure signal which may vary suddenly, into a suitable input for a microprocessor.

The invention overcomes this problem of continously measuring and transducing the airflow by not attempting to make this measurement but instead monitoring the engine speed and the throttle opening, since these two parameters determine the air flow under given atmospheric conditions, as the result of having previously determined the volumetric efficiency of the induction system comprising the air filter, inlet manifold, inlet valves and working chamber or chambers of the engine.

The airflow into an engine is the product of the swept volume, the frequency at which the volume is swept and the volumetric efficiency ($\eta$VOL). The volumetric efficiency is thus the proportion of the theoretical full charge which is actually drawn into the combustion chamber.

Figure 8:
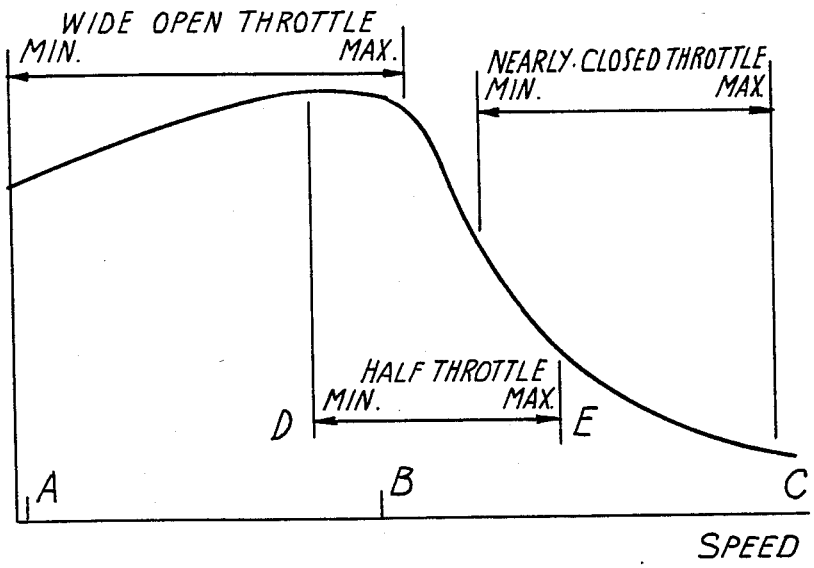
FIG. 8 is a graph of volumetric efficiency plotted against frequency or speed for a positive displacement pump drawing in air through a duct.

FIG. 8 shows the variation of volumetric efficiency with frequency (i.e. half engine speed for a four-stroke engine). Over the lower part A-B of the speed range, the volumetric efficiency is relatively high. Above the point B, however, the air velocity at some part of the system approaches the speed of sound, the resistance increases and the volumetric efficiency falls away to approach zero asymptotically in the higher speed range BC.

Typically, an internal combustion engine is required to operate over a speed range (for example 500–6000 rpm) much smaller than the total range AC. Thus, with the throttle wide open and offering minimal restriction the volumetric efficiency curve will correspond approximately to the left hand end portion AB (care being taken to avoid some flow conditions up to the top end of the speed range with the throttle wide open).

With partial closure of the throttle, some flow in the throttle will occur in the upper part of the speed range with subsonic flow in the lower part. Thus, the effect of reducing the throttle opening is to move the operating region to the right to DE in FIG. 1, the volumetric efficiency by a scaling factor representative of the reduced flow cross sectional area at the throttle.

With the throttle nearly closed, the flow is supersonic at all engine speeds and the operating region moves further to the right to the position EC.

Figure 9:
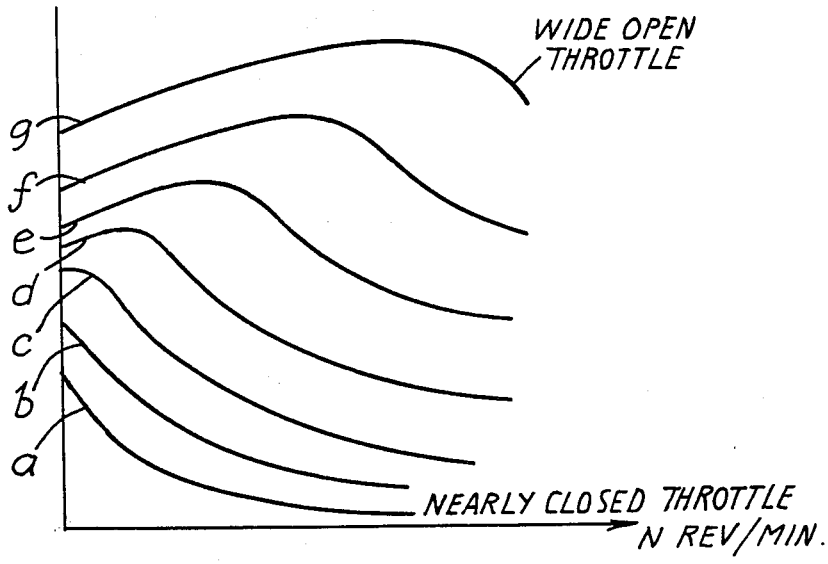
FIG. 9 is a graph showing a family of curves, each of which shows the induction volumetric efficiency of a piston-and-cylinder internal combustion engine for a particular throttle opening.

FIG. 9 shows a family of curves showing the variation of the volumetric efficiency with engine speed for a particular throttle setting. The curve a corresponds to the nearly closed condition of the throttle while the curve g corresponds to the fully open condition. The other curves b, c, d, e and f correspond to a range of increasing settings of the throttle opening.

By writing information corresponding to that given by FIG. 9 into the memory associated with the microprocessor, the latter can ascertain the volumetric efficiency instantaneously given the instantaneous values of throttle opening and engine speed. The air flow is proportional to the product of the volumetric efficiency and the engine speed. Accordingly, the quantity of fuel required to give a standard fuel air mixture is then also proportional to this product and can be instantaneously calculated by the microprocessor. The latter can also modify this result as required, for example to give a somewhat richer mixture at idling speeds, as a result of carrying out further instructions programmed into it.

Alternatively, the microprocessor memory can include values corresponding to the curve shown in FIG. 8 and means for moving the x and y co-ordinates and also the height of the curve in accordance with throttle opening.

Once the three dimensional graph corresponding to FIGS. 8 or 9 has been established for a particular engine, it will be found that this information can be applied to a wide range of engines by simple choice of appropriate multiplying constants, in all cases without the need for any attempt to measure the air flow through the induction system of the engine.

Figure 10:
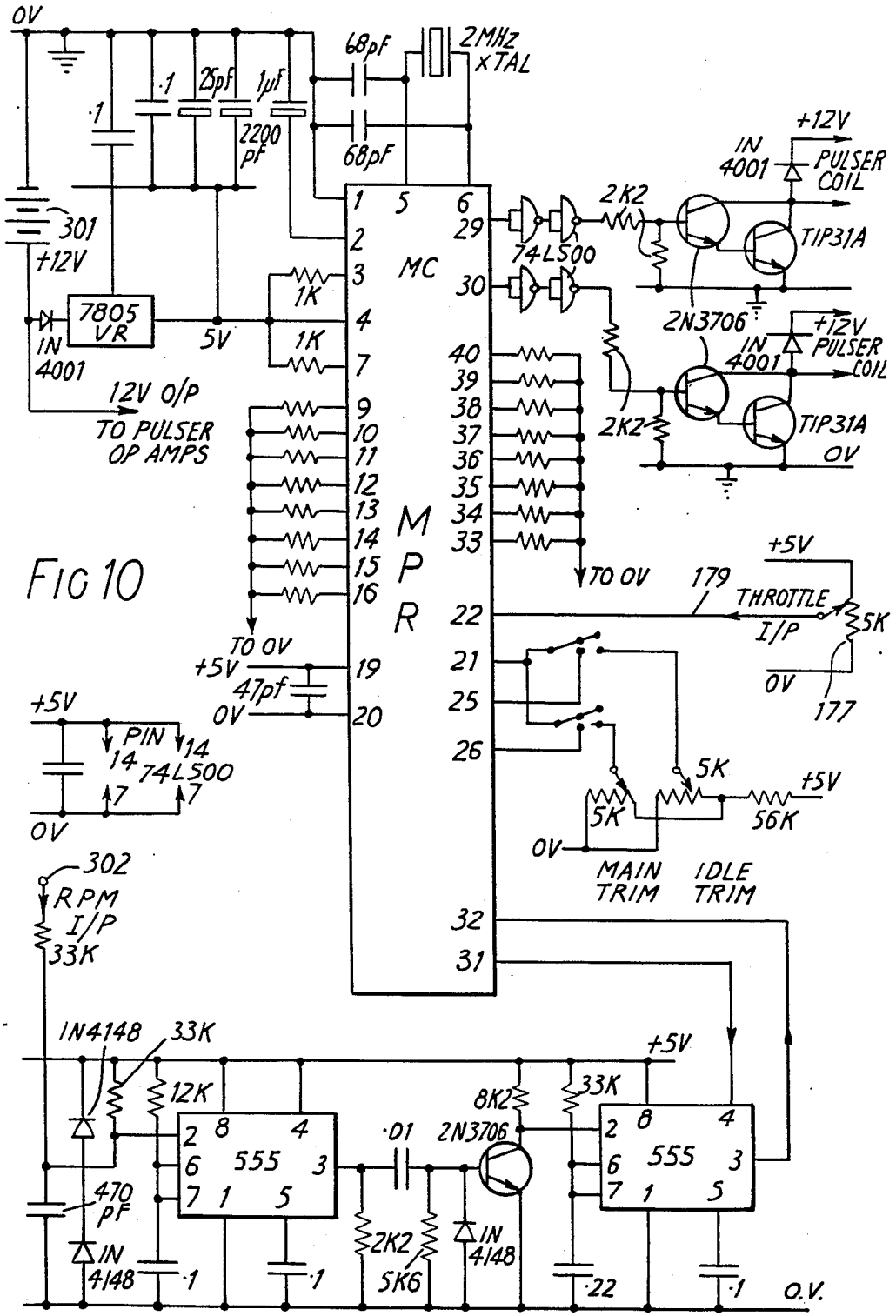
FIG. 10 is a circuit diagram of a microprocessor/-computer suitable for use in the systems shown in FIGS. 1 to 6.

FIG. 10 shows the circuit diagram of a control system suitable for use with the systems of FIGS. 1 and 2 or FIGS. 3 to 5.

The control system obtains its power from the battery 301 of the vehicle. A signal RPM representative of the speed of the engine is obtained from a pick-up (not shown) which may be of conventional kind either associated with the ignition circuit or, for example, a Hall-effect device mounted adjacent the flywheel of the engine and arranged to generate a pulse each time an element mounted on the flywheel passes it. This input signal RPM is supplied to a terminal 302. The processor unit MPR may be a Motorola type 68705R3 or a 6805R2. Alternatively, it may be a Hitachi HD6805W. Such devices contain analog to digital conversion channels as well as memories.

Figure 11:
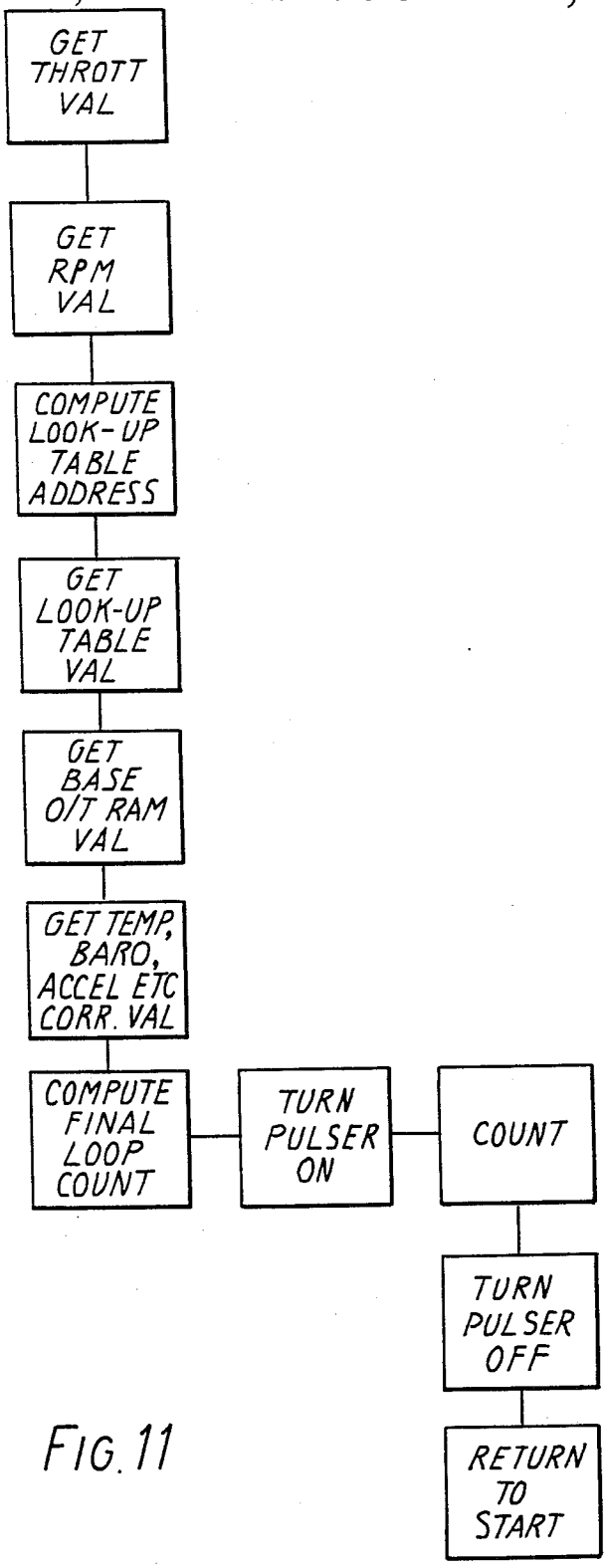
FIGS. 11 to 13 are flow charts of some of the routines programmed in to the microprocessor/-computer.
Figure 12:
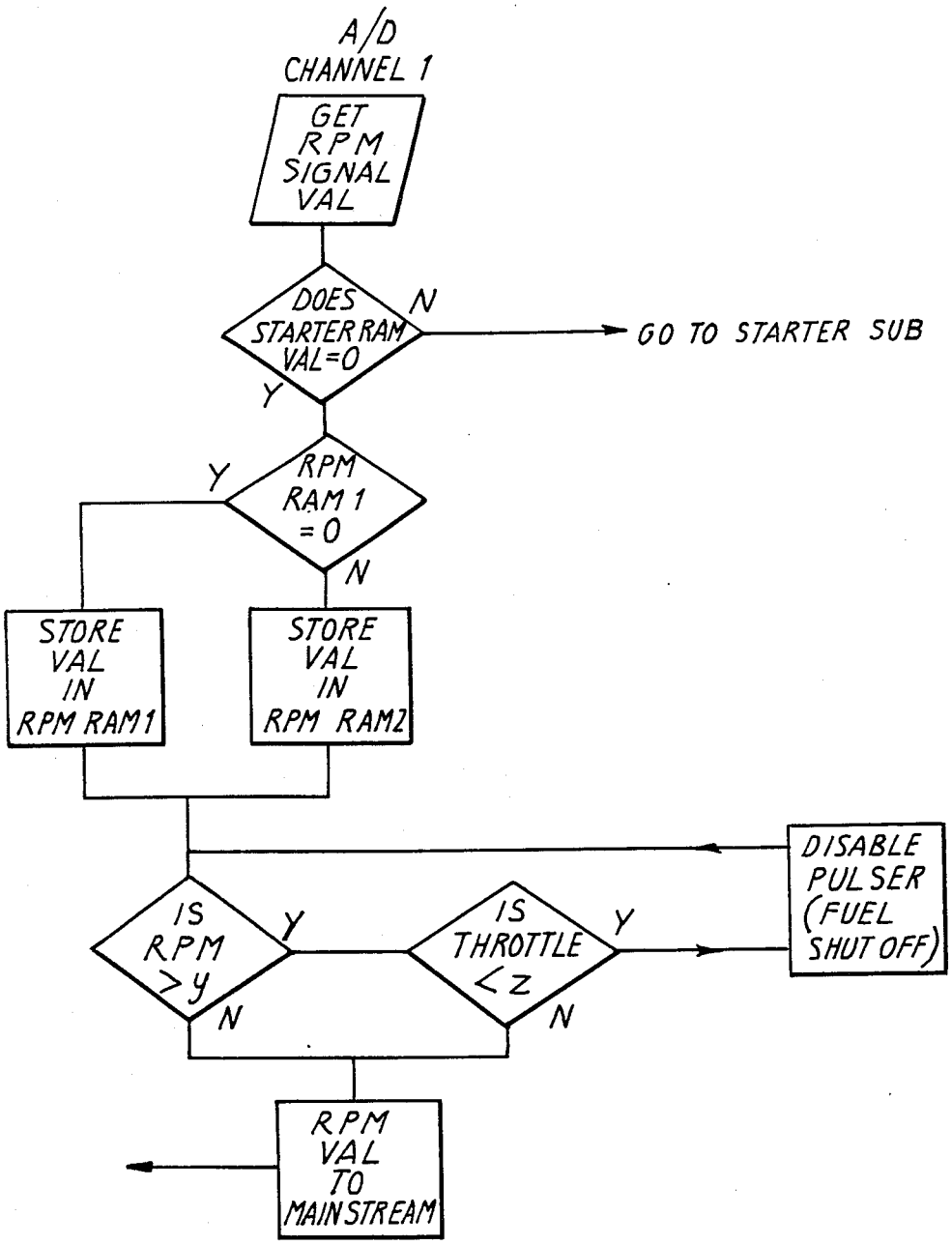

FIG. 11 is a flowchart showing a cycle of operations carried out to determine and control each "on" time or duration of a pulse delivered to the solenoid-operated valve. FIG. 12 shows the flowchart of an arrangement whereby the solenoid-operated valve is not energised so long as the engine speed is greater than a predetermined value y and the throttle opening is less than a predetermined value z. In this way, the fuel is shut off during the period when the engine is not required to deliver any power; for example when used to brake the vehicle.

Figure 13:
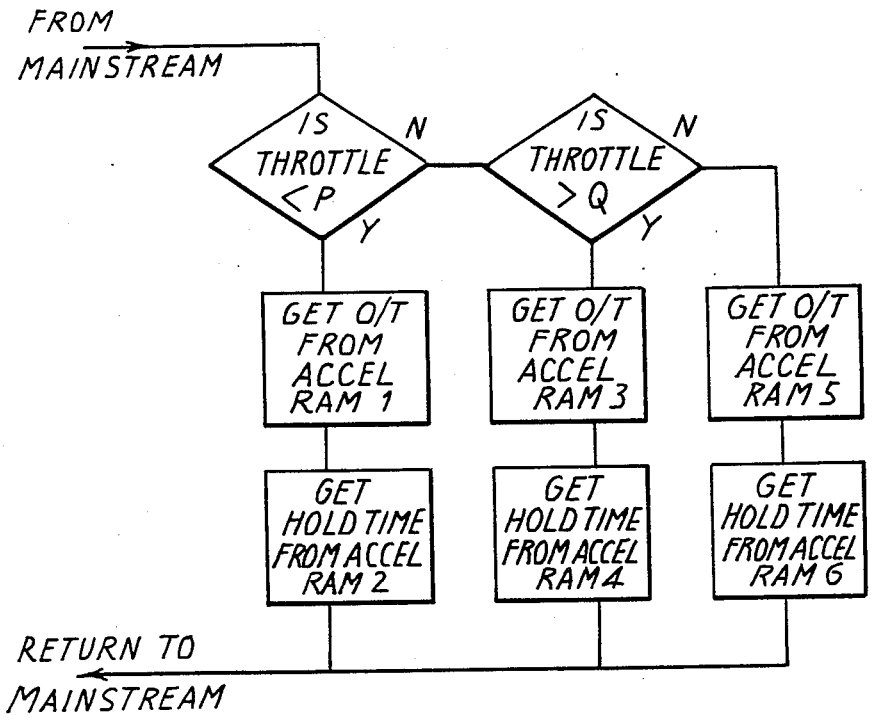

FIG. 13 shows a flowchart whereby the solenoid valve may be held open continuously in response to detection of sudden opening of the throttle calling for additional fuel to achieve acceleration.

In all the flowcharts, N="no" and Y="yes".

I claim:

1. Apparatus for supplying fuel to an internal combustion engine, having an air intake duct for said engine, a variable air throttle valve in said duct, and at least one nozzle for delivering fuel to said intake duct, said apparatus comprising (a) a source of fuel, (b) means defining a flow path for fuel from said source to said nozzle, (c) a metering valve in said flow path and having a variable constriction providing a variable flow resistance in said path, (d) link means linking said metering valve to said throttle valve to reduce said flow resistance of said metering valve with increasing opening of said throttle valve, said link means determining a specific value of said constriction for each position of said throttle, (e) an electrically operated on/off valve in said flow path, (f) an accumulator in said flow path downstream of said metering valve and said on/off valve, (g) control means for said on/off valve, said control means including a memory in which are stored values for the on time of said on/off valve in relation to predetermined values including engine speed and throttle opening, (h) an engine tachometer connected to said control means, and (i) a throttle opening transducer connected to said control means.

2. An apparatus according to claim 1, wherein said control means is responsive to increases in throttle opening above a given rate to further increase the on time of said on/off valve.

3. An apparatus according to claim 1, wherein the nozzle is mounted in the side wall of the intake duct leading to a combustion chamber, the nozzle comprising a small bore fuel delivery tube connected to the fuel flow path and mounted in an air passage connected to receive air from a supply bypassing the engine throttle, the air passage being convergent to an outlet for delivering fuel and air into the intake duct, the delivery tube being continuously connected to the fuel flow path, the pressure as maintained in the fuel flow path in relation to the dimensions of the delivery tube being insufficient to discharge a charge of fuel from the delivery tube in the absence of air movement in the air passage so that a charge of fuel is delivered by the delivery tube only during induction of a charge of air into the combustion chamber.

4. Apparatus according to claim 3, wherein the intake duct is formed with a venturi-like constriction adjacent the nozzle.

5. Apparatus according to claim 4, wherein the constriction is insufficient to cause supersonic air velocities therein.

6. Apparatus according to claim 3, wherein the air passage is convergent around the end of the delivery tube.

7. Apparatus according to claim 6, wherein the inlet end of the small bore delivery tube is oblique.

8. Apparatus according to claim 6, wherein the convergent portion of the air passage is sufficiently gradually convergent over a sufficient length to ensure acceleration of the airflow therethrough during an induction stroke to a supersonic velocity.

* * * * *